US006635613B1

(12) United States Patent
Ketelson

(10) Patent No.: US 6,635,613 B1
(45) Date of Patent: Oct. 21, 2003

(54) UREA PHOSPHATE CLEANING FORMULATION AND METHOD OF CLEANING A SURFACE

(75) Inventor: Howard A. Ketelson, Fort Worth, TX (US)

(73) Assignee: Trojan Technologies, Inc., London (CA)

( * ) Notice: Subject to any disclaimer, the term of this patent is extended or adjusted under 35 U.S.C. 154(b) by 525 days.

(21) Appl. No.: 09/664,795

(22) Filed: Sep. 19, 2000

(51) Int. Cl.[7] ..... C11D 3/06; C11D 3/08

(52) U.S. Cl. ..... 510/507; 510/195; 510/199; 510/436; 510/467; 510/485; 510/510; 510/534

(58) Field of Search ..... 510/195, 199, 510/436, 467, 485, 507, 510, 534

(56) References Cited

U.S. PATENT DOCUMENTS 5,460,742 A * 10/1995 Cavanagh et al. ..... 252/144

FOREIGN PATENT DOCUMENTS

| | | | |
|---|---|---|---|
| DE | 3840153 | * | 6/1989 |
| WO | 96/27654 | * | 9/1996 |
| WO | 98/56497 | * | 12/1998 |
| WO | 01/27236 | * | 4/2001 |

* cited by examiner

*Primary Examiner*—Charles Boyer
(74) *Attorney, Agent, or Firm*—Katten Muchin Zavis Rosenman

(57) ABSTRACT

A cleaning formulation comprising a cleaning agent, a particulate clay material and an aqueous carrier. The formulation has a pH less than about 4.0 and is characterized by at least a 90% reduction in viscosity at 25° C. at a shear rate of up to about 0.10 $s^{-1}$. The cleaning formulation is thixotropic and has a highly desirable combination of acid stability, temperature stability, electrolyte stability and ultraviolet radiation stability.

44 Claims, 3 Drawing Sheets

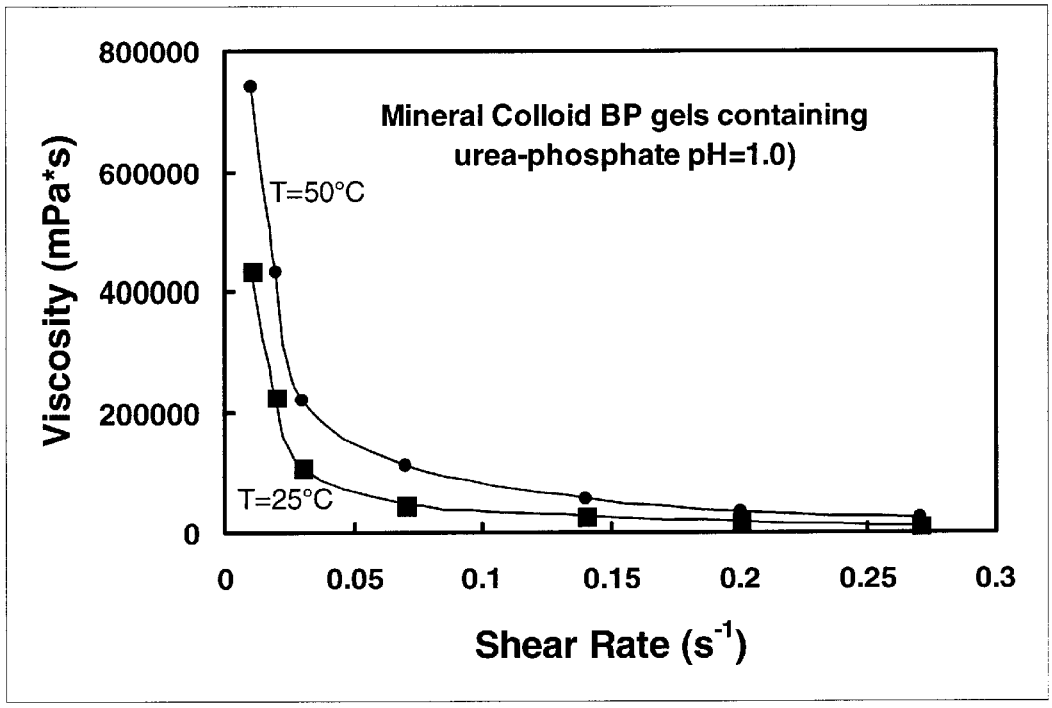
Figure 1. The variation of the viscosities as a function of shear rate for cleaning fluids containing urea-phosphate and mineral colloid BP at 25□C and 50□C.

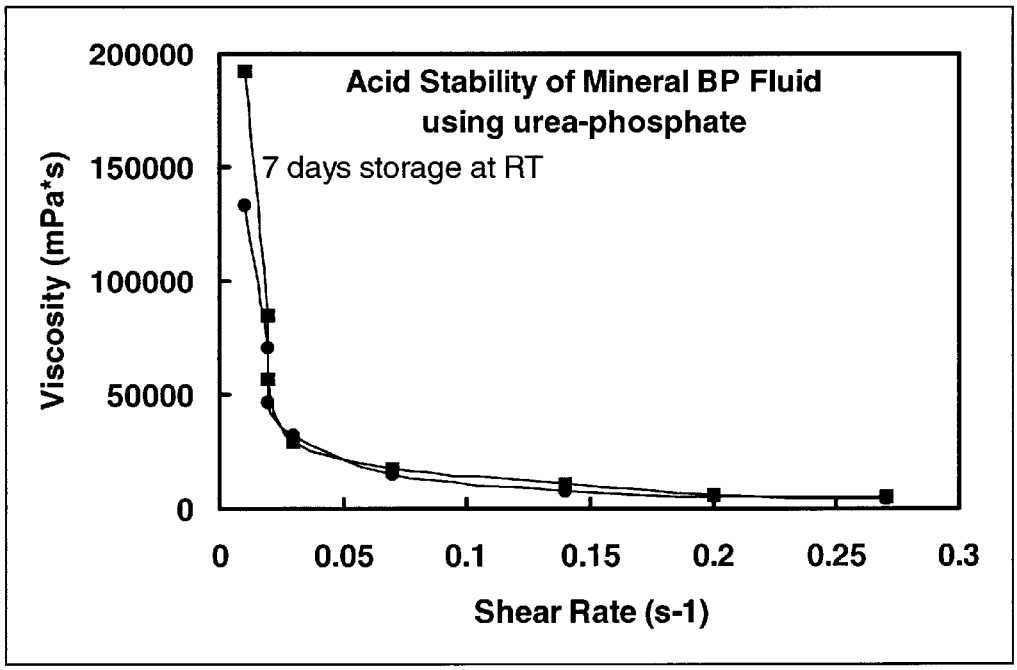
Figure 2. The variation of the viscosities as a function of shear rate for cleaning fluids containing urea-phosphate and mineral colloid BP after storage at 25°C for 7 days.

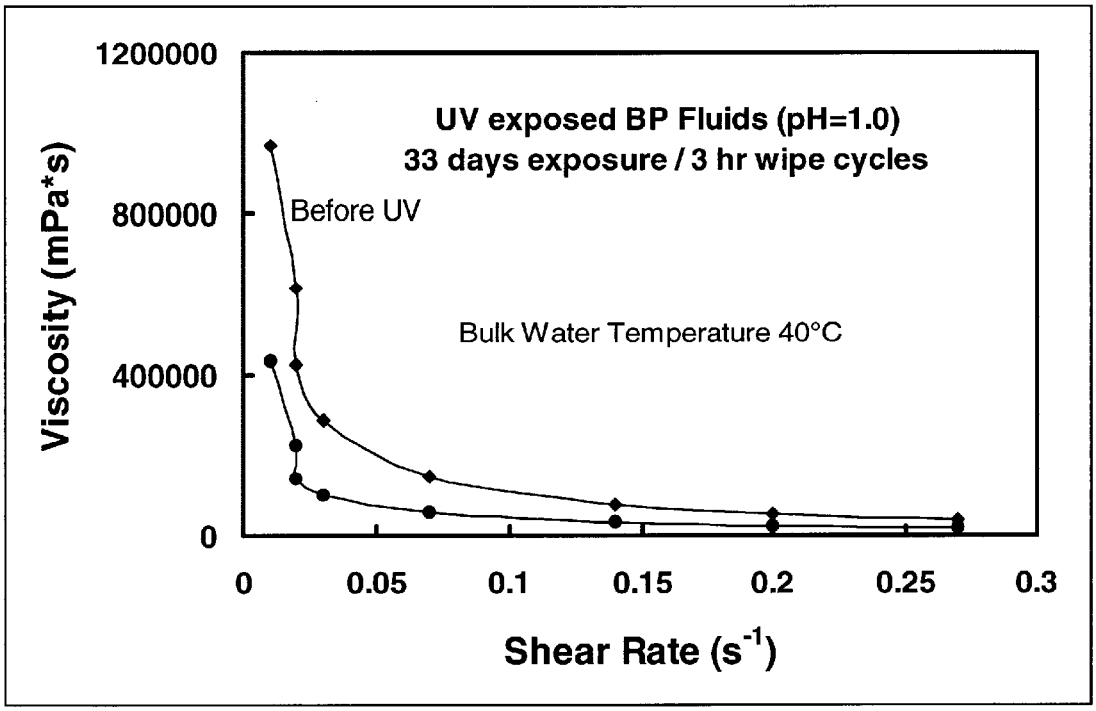
Figure 3. Influence of medium pressure UV on the viscosity profile of Mineral BP/urea-phosphate fluids as a function of shear rate.

UREA PHOSPHATE CLEANING FORMULATION AND METHOD OF CLEANING A SURFACE

BACKGROUND OF THE INVENTION

1. Field of the Invention

In one of its aspects, the present invention relates to a cleaning formulation for, inter alia, optical surfaces. In another of its aspects, the present invention relates to method for removing fouling materials, inter alia, from an optical surface.

2. Description of the Prior Art

Fluid treatment systems are known generally in the art.

For example, U.S. Pat. Nos. 4,482,809, 4,872,980 and 5,006,244 (all in the name of Maarschalkerweerd and all assigned to the assignee of the present invention and hereinafter referred to as the Maarschalkerweerd #1 Patents) all describe gravity fed fluid treatment systems which employ ultraviolet (UV) radiation.

Such systems include an array of UV lamp frames which include several UV lamps each of which are mounted within sleeves which extend between and are supported by a pair of legs which are attached to a cross-piece. The so-supported sleeves (containing the UV lamps) are immersed into a fluid to be treated, which is then irradiated as required. The amount of radiation to which the fluid is exposed is determined by factors such as: the proximity of the fluid to the lamps, the output wattage of the lamps, the fluid's flow rate past the lamps, the UV transmission (UVT) of the water or wastewater, the percent transmittance (%T) of the sleeves and the like. Typically, one or more UV sensors may be employed to monitor the UV output of the lamps and the fluid level is typically controlled, to some extent, downstream of the treatment device by means of level gates or the like.

However, disadvantages exist with the above-described systems. Depending upon the quality of the fluid which is being treated, the sleeves surrounding the UV lamps periodically become fouled with foreign materials, inhibiting their ability to transmit UV radiation to the fluid. For a given installation, the occurrence of such fouling may be determined from historical operating data or by measurements from the UV sensors. Once, or before fouling occurs, the sleeves must be cleaned to remove the fouling materials and optimize system performance.

If the UV lamp modules are employed in an open, channel-like system (e.g., such as the one described and illustrated in Maarschalkerweerd #1 Patents), one or more of the modules may be removed while the system continues to operate, and the removed frames may be immersed in a bath of suitable cleaning solution (e.g., a mild acid) which may be air-agitated to remove fouling materials. Of course, this necessitates the provision of surplus or redundant sources of UV radiation (usually by including extra UV lamp modules) to ensure adequate irradiation of the fluid being treated while one or more of the frames has been removed for cleaning. This required surplus UV capacity adds to the capital expense of installing the treatment system. Further, a cleaning vessel for receiving the UV lamp modules must also be provided and maintained. Depending on the number of modules which must be serviced for cleaning at one time and the frequency at which they require cleaning, this can also significantly add to the expense of operating and maintaining the treatment system. Furthermore, this cleaning regimen necessitates relatively high labour costs to attend to the required removal/re-installation of modules and removal/refilling of cleaning solution in the cleaning vessel. Still further, such handling of the modules results in an increased risk of damage to or breakage of the lamps in the module.

If the frames are in a closed system (e.g., such as the treatment chamber described in U.S. Pat. No. 5,504,335 (in the name of Maarschalkerweerd and assigned to the assignee of the present invention) removal of the frames from the fluid for cleaning is usually impractical. In this case, the sleeves must be cleaned by suspending treatment of the fluid, shutting inlet and outlet valves to the treatment enclosure and filling the entire treatment enclosure with the cleaning solution and air-agitating the fluid to remove the fouling materials. Cleaning such closed systems suffers from the disadvantages that the treatment system must be stopped while cleaning proceeds and that a large quantity of cleaning solution must be employed to fill the treatment enclosure. An additional problem exists in that handling large quantities of cleaning fluid is hazardous and disposing of large quantities of used cleaning fluid is difficult and/or expensive. Of course open flow systems suffer from these two problems, albeit to a lesser degree.

Indeed, once installed, one of the largest maintenance costs associated with prior art fluid treatment systems is often the cost of cleaning the sleeves about the radiation sources. U.S. Pat. Nos. 5,418,370, 5,539,210 and 5,590,390 (all in the name of Maarschalkerweerd and all assigned to the assignee of the present invention and hereinafter referred to as the Maarschalkerweerd #2 Patents) all describe an improved cleaning system, particularly advantageous for use in gravity fed fluid treatment systems which employ UV radiation. Generally, the cleaning system comprises a cleaning sleeve engaging a portion of the exterior of a radiation source assembly including a radiation source (e.g., a UV lamp). The cleaning sleeve is movable between: (i) a retracted position wherein a first portion of radiation source assembly is exposed to a flow of fluid to be treated, and (ii) an extended position wherein the first portion of the radiation source assembly is completely or partially covered by the cleaning sleeve. The cleaning sleeve includes a chamber in contact with the first portion of the radiation source assembly. The chamber is supplied with a cleaning solution suitable for removing undesired materials from the first portion of the radiation source assembly.

In International publication number WO 00/26144 [Pearcey et al. (Pearcey)], published May 11, 2000, there is disclosed a cleaning apparatus for a radiation source module and a radiation source module incorporated such cleaning apparatus. Generally, the cleaning apparatus and related module comprise: (i) a slidable member magnetically coupled to a cleaning sleeve, the slidable member being disposed on and slidable with respect to a rodless cylinder; and (ii) motive means to translate the slidable member along the rodless cylinder whereby the cleaning sleeve is translated over the exterior of the radiation source assembly.

Further improvements to cleaning devices are described in:

- copending U.S. patent application Ser. No. 09/258,142 [Traubenberg et al. (Traubenberg)], filed on Feb. 26, 1999;
- copending U.S. patent application Ser. No. 60/136,766 [Dall'Armi et al. (Dall'Armi)], filed on May 28, 1999; and
- copending U.S. patent application Ser. No. 60/148,648 [Fang et al.(Fang)], filed on Aug. 13, 1999;

each assigned to the assignee of the present invention.

The teachings of Pearcey, Traubenberg, Dall'Armi and Fang each represent important advances in the art, particularly when implemented in a fluid treatment module such as the one illustrated in the Maarschalkerweerd #1 Patents.

One area in the prior art which has received relatively little attention is the nature of the cleaning formulation used in such cleaning devices for optical radiation devices such as the ones taught in the Maarschalkerweerd #2 Patents and in Pearcey, Traubenberg, Dall'Armi and Fang.

It is known that the disinfection efficiency of a UV lamp is dependent on the cleanliness of the surface which houses the UV lamp—see Kreft, P.; Scheible, O.K.; Venosa, A. "HYDRAULIC STUDIES AND CLEANING EVALUATIONS OF ULTRAVIOLET DISINFECTION UNITS", Journal WPCF, Volume 58, Number 12, p.1129 [Kreft]. Cleaning of a ultraviolet disinfection system is important in order for the system to operate at optimum efficiency. Surface fouling can significantly affect the dose efficiency needed for meeting the disinfection requirements. Fused quartz sleeves, which are conventionally used to house the radiation lamps, are rated at an ultraviolet transmittance (UVT) of 80 to 90% when brand new. Maintaining the %UVT at or very close to 80% is highly desirable to sustain the ability to meet disinfection requirements.

Fouling on an ultraviolet radiation surface (e.g., the quartz sleeve surrounding the lamp) is complex and can vary from site to site. The three main contributors to fouling include inorganic deposits, organic fouling and biofilms (which can grow when the surfaces are fouled and not fully irradiated)—see Kreft.

The major fouling components of inorganic scale deposits typically comprise one or more of magnesium hydroxide, iron hydroxide, calcium hydroxides, magnesium carbonate, calcium carbonate, magnesium phosphate and calcium phosphate. These are salts with inverse solubility characteristics—i.e., the solubility of salt decreases with increasing temperature. It has been indicated that quartz sleeves used in ultraviolet radiation systems such as the ones described above will have a higher temperature at the quartz/water interface than that of the bulk solution—see Kreft. This has led to the suggestion that fouling of such quartz sleeves may arise from the inverse solubility characteristics of the inorganic salts. Other factors such as surface photochemical effects may also lead to fouling.

A conventional method for cleaning inorganic fouled surfaces uses acidic materials. It should be noted that basic chemicals such as ammonium hydroxide or sodium hydroxide are usually avoided due to their chemical interaction with quartz and their limited cleaning efficacy of inorganic debris.

The magnitude of the cleaning ability of acids on inorganic media (inorganic fouling generally consists of metal oxides and carbonates on the quartz or other surface) is related primarily to pH. At low pH, metal cations aquate more easily and, in the important case of fouling by carbonate anions, decomposition via $CO_2$ formation occurs. Acids further have the ability to disrupt ion bridging effects that give rise to fouling films like soap scum and also to solubilize precipitated fatty acid soaps. Most cleaning formulations use very strong acids to remove inorganic water spots, stains and encrustations on surfaces. The cleaning of inorganic substrates is most effectively accomplished by acid treatment when coupled with surfactants that can remove adsorbed organic/inorganic complexes (McCoy, J. W. "Industrial Chemical Cleaning" Chapter 2, pp.34. Chemical Publishing Co. New York, N.Y.).

Acids have the ability to disrupt the ion bridging effects which give rise to fouling films like soap scum and also to solubilize precipitated fatty acid soaps. Most cleaning formulations to date use strong acids to remove inorganic water spots, stains and encrustations on surfaces. Cleaning of inorganic fouling materials has been accomplished by acid treatment which, when coupled with surfactants, can remove adsorbed organic/inorganic complexes.

Wastewater treated by conventional ultraviolet radiation systems may also contain a wide variety of living organisms and organic-based molecules which range from those which are surface active to oils and greases. Surface active molecules, such as humic acids, which are negatively charged can bind polyvalent ions (calcium, iron, magnesium) contained in the water. Additionally, because the surface active molecules contain hydrophobic moieties the adhesion of ultraviolet radiation adsorbing species such as proteins or aromatics can also cause the transmission of the ultraviolet from the lamps to be reduced.

A number of chemicals have been suggested and used for cleaning scale deposits from surfaces with or without organic fouling materials. Inorganic acids such as hydrochloric acid, nitric acid, sulfuric acid, phosphoric acid and sulfamic acid are commonly used in the chemical cleaning of inorganic scale deposits—see Kreft. However all of these acids are corrosive and difficult to handle. Thus, an occupational health concern arises in using such acids. Also, there is an increased likelihood of wear and tear on equipment as a consequence of using such acids. Hydrochloric acid and sulfuric acid typically are not recommended in applications where exposure to stainless steel can occur due to their corrosive action. Nitric acid has oxidation capabilities and can only be used in a concentration of up to about 10% due to its potential reactivity. Phosphoric acid is a relatively safe and efficient cleaning acid, and has been used in a wide variety of industries. However, the use of phosphoric acid may contribute to the formation of insoluble phosphates with iron, calcium or magnesium. Additionally phosphate is a limiting nutrient for microbial and algae growth hence disposal of the cleaning solution and leakage into the treated water needs careful monitoring.

A novel cleaning formulation copending U.S. patent application Ser. No. 60/207,187 [Ketelson et al. (Ketelson)], filed on May 26, 2000. The cleaning formulation taught by Ketelson represents a significant improvement in the art. Specifically, the formulation taught by Ketelson has one or more of the following attributes:

(i) it can remove foreign deposits of organic, biological and inorganic origin from optical and/or metal surfaces;

(ii) it does not chemically interact substantially with the optical surface or leave residual adsorbed species which will substantially reduce the % UVT;

(iii) it is relatively safe to handle and is relatively non-corrosive to human skin;

(iv) it meets the current standards for governing environmentally acceptable usefulness in the wastewater and potable water industries;

(v) it maintains its cleaning activity over time (e.g., months) while being exposed to ultraviolet radiation;

(vi) it possesses anti-microbial properties;

(vii) it is substantially compatible with one or more other ingredients known in the art of cleaning formulations, including surfactants, wetting agents, thickeners, sequestrants and chelating agents;

(viii) it is substantially compatible for use in a wiper compartment and neither substantially degrades the seal material nor substantially retards wiper movement across a surface;

(ix) it is substantially useful in combination with thickeners that exhibit shear thinning properties in order to maintain control over its flow properties;

(x) it meets FDA guidelines for excipients or additives in food or drugs; and (xi) it is not substantially corrosive toward stainless steel.

Despite the advance in the art provided by Ketelson, there is room for improvement. Specifically, when liquid cleaning formulations, such as the one taught by Ketelson, are used in cleaning systems such as the one taught in the Maarschalkerweerd #2 Patents, there is a likelihood that the liquid cleaning formulation will leak out of the cleaning chamber over time. This is disadvantageous when the fluid treatment system in question is used in a clean (i.e., drinking) water application. Further, this is disadvantageous in that increased costs of cleaning formulations are incurred.

In light of this, it would be desirable to have an improved cleaning formulation which combined the benefits of the cleaning formulation taught by Ketelson while obviating or mitigating the leakage and/or cost problems referred to in the previous paragraph.

SUMMARY OF THE INVENTION

It is an object of the present invention to provide a novel cleaning formulation which obviates or mitigates at least one of the above-mentioned disadvantages of the prior art.

It is another object of the present invention to provide a novel method for removing fouling materials from an optical surface.

Accordingly, in one of its aspects, the present invention provides a cleaning formulation comprising a cleaning agent, a particulate clay material and an aqueous carrier, the formulation having a pH less than about 4.0 and characterized by at least a 90% reduction in viscosity at 25° C. at a shear rate of up to about 0.10 $s^{-1}$.

In another of its aspects, the present invention provides a method for removing fouling materials from a surface comprising the step of application to the surface a formulation comprising a cleaning agent, a particulate clay material and an aqueous carrier, the formulation having a pH less than about 4.0 and characterized by at least a 90% reduction in viscosity at 25° C. at a shear rate of up to about 0.10 $s^{-1}$.

Thus, the present inventor has surprisingly and unexpectedly discovered an acidic (i.e., pH<4) cleaning formulation which is thixotropic (also referred to herein as "shear thinning") and has a highly desirable combination of acid stability, temperature stability, electrolyte stability and ultraviolet radiation stability. Further, an additional advantage of the present cleaning formulation is that it confers lubricity to an interface between the surface being cleaned and the wiper, chamber or the like which is moved across the surface.

BRIEF DESCRIPTION OF THE DRAWINGS

Embodiments of the present invention will be described with reference to the accompanying drawings, in which:

FIG. 1 illustrates the variation of the viscosities as a function of shear rate for an embodiment of the present cleaning formulation at 25° C. and 50° C.;

FIG. 2 illustrates the variation of the viscosities as a function of shear rate for an embodiment of the present cleaning formulation after storage at 25° C. for 7 days; and FIG. 3 illustrates the influence of medium pressure UV on the viscosity profile of an embodiment of the present cleaning formulation as a function of shear rate.

DETAILED DESCRIPTION OF THE PREFERRED EMBODIMENTS

Thus, the present cleaning formulation comprises a cleaning agent, a particulate clay material and an aqueous carrier.

Preferably, the cleaning agent comprises a urea-phosphate salt.

Urea-phosphate, is a derivative of a urea and a phosphorus containing acid. It possesses less corrosive properties than the mineral acids noted above: the compound is, in the first instance, less acidic and, without being bound by any particular theory or mode of action, this is believed to be due to the urea complexing with the acid to reduce the aggressive nature of the acid.

Normally, the addition of even weak bases such as urea (or the organic acids noted above to strong acids) to strong acids leads to complex formation—strong acids protonate the weak bases forming salts that when dissolved in water act as buffer solutions. Crystal structures show these interactions: urea nitrate is a pure salt (Worsham, J. E., Jr.; Busing, W. *R. Acta Cryst.* 1969, B25, 572), urea phosphate has the exchangeable proton equidistant between the urea and the phosphoric acid (Nozik, Yu. Z.; Fykin, I. E.; Bukin, V. I.; Muradyan, L. A. *Kristallografiya* 1976, 21, 7340, Kostansek, E. C.; Busing, W. R. *Acta Cryst. B.* 1972, 28, 2454), in urea oxalate, the proton remains associated with the oxalic acid (Kostansek, E. C.; Busing, W. R. *Acta Cryst. C* 1972, B28, 2454).

Based on this observation, one might have expected that urea-acid complexes would behave as buffers—that is, with the urea acting as a weak base. However, as described in Ketelson, an examination of the pH profile of the complexes, when compared to the free acid, showed that urea does not affect the pH profile of phosphoric acid. Thus, urea behaves to moderate the corrosiveness of phosphoric acid, already a weak acid, without affecting the pKa.

Urea-phosphate useful in the preferred cleaning formulation of the present invention can be formed with any desired ratio of urea and phosphate that performs the desired function. Examples of suitable salts include those formed by combining urea and a phosphorus-containing acid (e.g., phosphoric acid, phosphonic acid, derivatives thereof and the like) in a molar ratio in the range of from about 1:1 and to about 1:4, preferably a molar ratio of from about 1:1 to about 1:2 (urea:phosphoric acid).

In the preferred embodiment, urea is the only base used in combination with phosphorus-contained acid in the composition. In an alternative embodiment, the salt of a phosphorus-containing acid with urea or weak base can be used in place of urea phosphate if, when combined with a water insoluble metal salt, it produces a water soluble metal salt. Examples include mixtures of strong acids with, for example, alkanolamines, including triethanolamine, diethanolamine, monoethanolamine and $HO—[(alkyl)O]_x—CH_2)_yNH_2$, including $HO—[(CH_2)_xO]—CH_2)_xNH_2$; wherein the alkyl group can vary within the moiety, wherein x is 1–8 (which can vary within the moiety) and y is an integer of 1 to 40; alkylamines, dialklylamines, trialkylamines, alklytetramines, polymers with amino or (alkyl or aryl) amino substituents groups, polymers with nitrogen-containing heterocyclic groups, arcylamide, polymers an copolymers of acrylamide, vinyl pyrollidone, polyvinyl pyrollidone, copolymers of vinyl pyrollidone, metharcylamide, polymetharcylamide, copolymers of acrylamide, and ammonia (which when combined with HCl forms ammonium chloride, which dissolves water-insoluble salts at a slow rate). Mixtures of these bases can also be used.

In accordance with a preferred embodiment of the present invention, urea-phosphate, formed from the reaction between urea and phosphoric acid, is used as an active ingredient to prepare cleaning chemical compositions which can be used with or without physical devices for cleaning applications for the removal of foreign matter deposited on surfaces such as optical surfaces and/or metal surfaces. Optionally, the urea-phosphate may be formulated with at least one surfactant to provide formulations which are non-streaking, non-film forming as well as of low toxicity for particular applications but not limited to cleaning of fouled surfaces derived from wastewater and potable water applications. Additionally the efficacy of cleaning is not diminished by the influence of UV irradiation. Although the urea-phosphate is the main active ingredient, several optional ingredients may also be used. Optional ingredients to enhance the cleaning efficacy include surfactants, builders, sequestrants, anti-fog polymers and thickeners.

Also, the present cleaning formulation may comprise a cleaning agent other than urea phosphate provided the use of such other cleaning agents does not necessitate inclusion of supplementary additives which would deleteriously affect the formulation. For example urea hydrochloride, urea sulfate, phosphonic acid and the like would be expected to be useful in the present cleaning formulation. Other useful cleaning agents can be identified by those skilled in the art.

The present cleaning formulation further comprises a particulate clay material. As used throughout this specification the term "clay material" is intended to encompass a crystalline material comprising a plurality of silicate (including aluminosilicates) sheets which are held together by metal (e.g., alkali metals or alkaline earth metals) ions or hydroxide ions.

Preferably, the particulate clay material comprises a bentonite clay. More preferably, the particulate clay material comprises an alkali metal bentonite clay. Most preferably, the particulate clay material comprises a sodium bentonite clay.

The present cleaning formulation further comprises an aqueous carrier. Preferably, the aqueous carrier comprises water.

The present cleaning formulation has a pH less than about 4.0. Preferably, the pH is in the range of from about 0.5 to about 4.0. More preferably, the pH is in the range of from about 0.5 to about 3.0. Most preferably, the pH is in the range of from about 0.5 to about 1.5.

Preferably the particulate clay material is present in an amount in the range of up to about 10 percent by weight. More preferably, the particulate clay material is present in an amount in the range of from about 0.5 to about 10 percent by weight. Even more preferably, the particulate clay material is present in an amount in the range of from about 0.5 to about 5.0 percent by weight. Most preferably, the particulate clay material is present in an amount in the range of from about 0.3 to about 3.0 percent by weight.

The present cleaning formulation is characterized by an at least a 90% reduction in viscosity at 25° C. at a shear rate of up to about 0.10 $s^{-1}$. Preferably, the formulation is characterized by an at least a 90% reduction in viscosity at 25° C. at a shear rate of up to about 0.05 $s^{-1}$. More preferably, the formulation is characterized by an at least a 90% reduction in viscosity at 25° C. at a shear rate of up to about 0.03 $s^{-1}$.

In another preferred embodiment, the formulation is characterized an at least a 95% reduction in viscosity at 25° C. at a shear rate of up to about 0.10 $s^{-1}$, more preferably an at least a 95% reduction in viscosity at 25° C. at a shear rate of up to about 0.05 $s^{-1}$, most preferably an at least a 95% reduction in viscosity at 25° C. at a shear rate of up to about 0.03

Embodiments of the invention will be described with reference to the following Example, which should not be used to construe or limit the invention.

In the following Example, the following materials were used 1. mineral colloid BP (Southern Clay Products Inc.);
2. urea (ACS grade, Fisher Scientific); and
3. o-phosphoric acid (85%, Fisher Scientific).

Mineral Colloid BP is a high purity montmorillonite refined from carefully selected natural bentonite. It is classified as a specialty thixotrope that is characterized by high efficiency and relatively low usage levels. It exhibits high viscosity, interacts with both inorganic and organic cations.

The following are properties of mineral colloid BP:

| Typical Physical Properties | |
|---|---|
| Form: | Fine off white powder |
| Odor: | None |
| Brightness (GEB): | 60 |
| Moisture Content: | 7.5% |
| pH: | 9.70 |
| Viscosity (5% solids) | 2200 cps |
| Swelling | 46 mL |
| Arsenic | 2.0 ppm |
| Lead | 27.0 ppm |

| Typical Chemical Properties | |
|---|---|
| $SiO_2$: | 66.2% |
| $Al_2O_3$: | 17.5% |
| MgO | 2.0% |
| $Fe_2O_3$ | 3.8% |
| CaO | 0.8% |
| $Na_2O$ | 2.6% |
| $K_2O$ | 0.1% |

Preparation of Urea Phosphate (1M)

707g phosphoric acid (6.1 moles) was added to a 1 L beaker and 315 g urea (5 moles) was added with stirring using a paddle stirrer attached to a Heidolph™ mixer. The mixing speed was initially set at 300 rpm, but as the solution viscosity increased, any further mixing was carried out by hand. A large exotherm was generated during this reaction and therefore the reaction was monitored at all times. When the urea pellets were observed to dissolve, the viscosity of the mixture was observed to rapidly increase. At this time the mixture was removed from the mixer and stirred by hand using a spatula. After the reaction was complete, the urea phosphate was separated as a white crystalline solid.

To prepare a 1M urea phosphate solution, 160 g of the white crystalline solid was diluted up to 1L with Milli-Q™ water.

Preparation of Urea Phosphate (1 M) Containing Mineral Colloid BP (Shear Thinning Solution)

150 g of Milli-Q™ water (room temperature) was added to a beaker and stirred at 1000 rpm. To the stirred water was added (through a sifter) 3 g of Mineral Colloid BP. This addition was carried out slowly to minimize dusting along sides of vessel and mixer. The mixing process following the addition of the BP colloid was carried out for 30 minutes.

To a 50 mL beaker was added 16 g of urea-phosphate produce as above and 22 g Milli-Q™ water. The solids were stirred with a magnetic stirrer until dissolved. This solution was subsequently added dropwise to the Colloid BP slurry at a mixing speed of 800 rpm. The dispersion quickly increased in viscosity following the addition of the urea-phosphate solution. After 10 minutes of mixing the shear thinning product was prepared.

Characterization

Viscosity measurements were carried out using a Brookfield™ DVII+Programmable Viscometer (Brookfield™ SC4-27 spindle) interfaced with a small sample adapter. The adapter was jacketed and interfaced with a water bath set a pre-defined temperature.

The stability of the cleaning formulation to ultraviolet radiation was evaluated using an ultraviolet radiation module similar to the one taught in the Maarschalkerweerd #2 Patents.

Temperature and Acid Stability

In a typical ultraviolet water treatment system, the quartz sleeve/water interface temperature is expected to be at least 20–40° C. above the bulk water temperature in the waste stream. On this basis, the rheological character of the system was investigated at higher temperatures.

FIG. 1 illustrates the viscosity profiles of urea-phosphate solutions (pH=1.0) thickened with BP as a function of shear rate at 25° C. and 50° C.

FIG. 1 shows the viscosities obtained at 25° C. were much lower at any given shear rate relative to those obtained at 50° C. For example, at 25° C., the viscosities at 0.01 $s^{-1}$ and 0.03 $s^{-1}$ were 433000 mpa*s and 108000 mpa*s, respectively. Comparatively, the viscosities at 50° C. were 742000 mpa*s and 220000 mpa*s, respectively, at shear rates of 0.01 $s^{-1}$ and 0.03 $s^{-1}$, respectively. These results indicated that the viscosities of the cleaning fluids containing mineral BP colloid are expected to increase with temperature.

The influence of pH on the gel stability was investigated by monitoring the shear thinning profiles over a 7 day period.

FIG. 2 shows that the viscosities of the gel formulations increased slightly over a 7 day period. This should not be surprising as following the formulation preparation there is a structuring process (i.e., changes on the electrical double layer thickness) that continues for several days. It should be noted that clay based systems are particularly sensitive to low pH. Addition of salts or abrupt changes in pH can cause clay particle flocculation. Particular care was taken when the urea-phosphate was added to the clay dispersion (i.e., slow addition of urea-phosphate to minimize "shock"). Although bentonite does have a wide pH tolerance (pH 6 to 12) it is susceptible to low pH's and it was surprising to find that the shear thinning profile could be maintained with relatively high concentrations of urea-phosphate (i.e.,8.5 wt/wt%).

UV Stability

FIG. 3 shows a plot of the mineral BP/urea-phosphate fluids in the absence and presence of medium pressure ultraviolet (UV) radiation.

A ultraviolet radiation module similar to the taught in the Maarschalkerweerd #2 Patents was used to investigate the effect of medium pressure UV radiation on the viscosity of the fluid. FIG. 2 shows that there was a significant drop in viscosity at low shear rates for both the after UV and before UV experiments. The results showed that after wiping and exposure to UV the shear thinning profile of the BP fluid could be maintained. On the other hand a two-fold drop in viscosity was noted when the same shear rates of the before UV and after UV experiments were compared.

When the wiping sequence was initiated with UV on, an immediate visible sign of friction reduction was noticed using the formulation produced above (relative to neat urea-phosphate solution taught in Ketelson). This effect was maintained throughout the entire UV experiment.

The urea-phosphate gel produced above was evaluated in a fluid treatment system similar to the one taught in the Maarschalkerweerd #2 Patents to investigate its properties under normal operating field conditions. Bank A/Module 5 (Collar L1/L2) was injected with the gel and the wiping cycles were set at 3hrs. After 170 hrs of UV operation the module was lifted and the collar contents were inspected. A few large air pockets were observed in the collar but no visual change in viscosity was noted. Additionally, there was minimal stick-slip observed when the wiping sequence was initiated in air (relative to a cleaning formulation commercially available under the tradename Lime-Away™). This provides further supporting evidence that the addition of the bentonite to the urea-phosphate adds a "lubrication" benefit. Another useful property of the bentonite is its color (opaque) which does not change when it is exposed to medium pressure UV. This is believed to be an advantage over Lime-Away™which changes from green to clear after a few hours of UV exposure.

The foregoing experimental work supports the following conclusions:

1. Stable shear thinning gels of urea phosphate containing Mineral BP (bentonite) can be readily prepared at a pH of about 1.0. The shear thinning behavior was maintained over long term storage.
2. The influence of temperature on the shear thinning behavior was investigated and the results showed that no significant effect was observed using a temperature of 50° C.
3. The shear thinning behavior was not substantially influenced by short term exposure (33 days-3 hr wipe cycles) to UV radiation.

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. It is therefore contemplated that the appended claims will cover any such modifications or embodiments.

All publications, patents and patent applications referred to herein are incorporated by reference in their entirety to the same extent as if each individual publication, patent or patent application was specifically and individually indicated to be incorporated by reference in its entirety.

What is claimed is:

1. A cleaning formulation comprising a urea phosphate cleaning agent, a particulate clay material and an aqueous carrier, the formulation having a pH less than about 4.0 and characterized by at least a 90% reduction in viscosity at 25° C. at a shear rate of up to about 0.10 $s^{-1}$.

2. The cleaning formulation defined in claim 1, wherein the particulate clay material comprises a bentonite clay.

3. The cleaning formulation defined in claim 1, wherein the particulate clay material comprises an alkali metal bentonite clay.

4. The cleaning formulation defined in claim 1, wherein the particulate clay material comprises a sodium bentonite clay.

5. The cleaning formulation defined in claim 1, wherein aqueous carrier comprises water.

6. The cleaning formulation defined in claim 1, wherein the pH is in the range of from about 0.5 to about 4.0.

7. The cleaning formulation defined in claim 1, wherein the pH is in the range of from about 0.5 to about 3.0.

8. The cleaning formulation defined in claim l, wherein the pH is in the range of from about 0.5 to about 1.5.

9. The cleaning formulation defined in claim 1, wherein the particulate clay material is present in an amount in the range of up to about 10 percent by weight.

10. The cleaning formulation defined in claim 1, wherein the particulate clay material is present in an amount in the range of from about 0.5 to about 10 percent by weight.

11. The cleaning formulation defined in claim 1, wherein the particulate clay material is present in an amount in the range of from about 0.5 to about 5.0 percent by weight.

12. The cleaning formulation defined in claim 1, wherein the particulate clay material is present in an amount in the range of from about 0.3 to about 3.0 percent by weight.

13. The cleaning formulation defined in claim 1, characterized at least a 90% reduction in viscosity at 25° C. at a shear rate of up to about 0.05 $s^{-1}$.

14. The cleaning formulation defined in claim 1, characterized by at least a 90% reduction in viscosity at 25° C. at a shear rate of up to about 0.03 $s^{-1}$.

15. The cleaning formulation defined in claim 1, characterized by at least a 95% reduction in viscosity at 25° C. at a shear rate of up to about 0.10 $s^{-1}$.

16. The cleaning formulation defined in claim 1, characterized by at least a 95% reduction in viscosity at 25° C. at a shear rate of up to about 0.05 $s^{-1}$.

17. The cleaning formulation defined in claim 1, characterized by at least a 95% reduction in viscosity at 25° C. at a shear rate of up to about 0.03 $s^{-1}$.

18. The cleaning formulation defined in claim 2, wherein the urea-phosphate salt is a reaction product of urea and a phosphorus-containing acid.

19. The cleaning formulation defined in claim 18, wherein the phosphorus-containing acid comprises phosphoric acid and derivatives thereof.

20. The cleaning formulation defined in claim 18, wherein the phosphorus-containing acid comprises phosphonic acid and derivatives thereof.

21. The cleaning formulation defined in claim 18, wherein the ratio of urea to phosphorus-containing acid is in the range of from about 1:10 to 10:1.

22. The cleaning formulation defined in claim 2, wherein the urea-phosphate salt is present in an amount in the range of from about 0.5 to about 60 percent by weight.

23. A method for removing fouling materials from a surface comprising the step of application to the surface of a formulation comprising a urea phosphate cleaning agent, a particulate clay material and an aqueous carrier, the formulation having a pH less than about 4.0 and characterized by at least a 90% reduction in viscosity at 25° C. at a shear rate of up to about 0.10 $s^{-1}$.

24. The method defined in claim 23, wherein the particulate clay material comprises a bentonite clay.

25. The method defined in claim 23, wherein the particulate clay material comprises an alkali metal bentonite clay.

26. The method defined in claim 23, wherein the particulate clay material comprises a sodium bentonite clay.

27. The method defined in claim 23, wherein the aqueous carrier comprises water.

28. The method defined in claim 23, wherein the pH is in the range of from about 0.5 to about 4.0.

29. The method defined in claim 23, wherein the pH is in the range of from about 0.5 to about 3.0.

30. The method defined in claim 23 wherein the pH is in the range of from about 0.5 to about 1.5.

31. The method defined in claim 23, wherein the particulate clay material is present in an amount in the range of up to about 10 percent by weight.

32. The method defined in claim 23, wherein the particulate clay material is present in an amount in the range of from about 0.5 to about 10 percent by weight.

33. The method defined in claim 23, wherein the particulate clay material is present in an amount in the range of from about 0.5 to about 5.0 percent by weight.

34. The method defined in claim 23, wherein the particulate clay material is present in an amount in the range of from about 0.3 to about 3.0 percent by weight.

35. The method defined in claim 23, the formulation characterized by at least a 90% reduction in viscosity at 25° C. at a shear rate of up to about 0.05 $s^{-1}$ .

36. The method defined in claim 23, the formulation characterized by at least a 90% reduction in viscosity at 25° C. at a shear rate of up to about 0.03 $s^{-1}$.

37. The method defined in claim 23, the formulation characterized by at least a 95% reduction in viscosity at 25° C. at a shear rate of up to about 0.10 $s^{-1}$.

38. The method defined in claim 23, the formulation characterized by at least a 95% reduction in viscosity at 25° C. at a shear rate of up to about 0.05 $s^{-1}$.

39. The method defined in claim 23, the formulation characterized by at least a 95% reduction in viscosity at 25° C. at a shear rate of up to about 0.03 $s^{-1}$.

40. The method defined in claim 24, wherein the urea-phosphate salt is a reaction product of urea and a phosphorus-containing acid.

41. The method defined in claim 40, wherein the phosphorus-containing acid comprises phosphoric acid and derivatives thereof.

42. The method defined in claim 40, wherein the phosphorus-containing acid comprises phosphonic acid and derivatives thereof.

43. The method defined in claim 40, wherein the ratio of urea to phosphorus-containing acid is in the range of from about 1:10 to 10:1.

44. The method defined in claim 40, wherein the urea-phosphate salt is present in an amount in the range of from about 0.5 to about 60 percent by weight.

* * * * *